US011691411B2

(12) United States Patent
Rudolph

(10) Patent No.: US 11,691,411 B2
(45) Date of Patent: Jul. 4, 2023

(54) METHOD AND APPARATUS FOR ATTACHING A PRINTING PLATE TO A PRINTING CYLINDER

(71) Applicant: Bobst Bielefeld GmbH, Bielefeld (DE)

(72) Inventor: Frank Rudolph, Versmold (DE)

(73) Assignee: BOBST BIELEFELD GMBH, Bielefeld (DE)

( * ) Notice: Subject to any disclaimer, the term of this patent is extended or adjusted under 35 U.S.C. 154(b) by 0 days.

(21) Appl. No.: 17/455,570

(22) Filed: Nov. 18, 2021

(65) Prior Publication Data

US 2022/0153013 A1 May 19, 2022

(30) Foreign Application Priority Data

Nov. 19, 2020 (EP) ..... 20208583

(51) Int. Cl.
*B41F 27/00* (2006.01)
*B41F 5/24* (2006.01)
*B41F 27/12* (2006.01)

(52) U.S. Cl.
CPC ..... *B41F 27/005* (2013.01); *B41F 5/24* (2013.01); *B41F 27/1275* (2013.01)

(58) Field of Classification Search
CPC ..... B41F 27/005; B41F 5/24; B41F 27/1275
See application file for complete search history.

(56) References Cited

U.S. PATENT DOCUMENTS 5,549,044 A * 8/1996 Achelpohl ..... B41F 13/24 101/477
5,626,076 A * 5/1997 Ireton ..... B41F 27/005 101/481
5,676,058 A * 10/1997 Ireton ..... B41F 27/005 101/415.1

(Continued)

FOREIGN PATENT DOCUMENTS

CN 1417028 A 5/2003
CN 1781704 A 6/2006

(Continued)

*Primary Examiner* — David H Banh
(74) *Attorney, Agent, or Firm* — Bookoff McAndrews, PLLC

(57) ABSTRACT

A method for attaching a printing plate (12), especially a flexographic printing plate, to a printing cylinder (14) is described. In a first step, the printing plate (12) is provided in a substantially flat condition. Thereafter, an outer circumference of the printing cylinder (14) is arranged adjacent to an edge of the printing plate (12). Subsequently, the printing cylinder (14) is translatorily moved over the printing plate (12) while rotating such that the printing plate (12) is rolled-up on the printing cylinder (14). Additionally, an apparatus (10) for attaching a printing plate (12) to a printing cylinder (14) is presented. The apparatus (10) comprises a printing plate support unit (16) having a substantially flat support surface (18) for supporting the printing plate (12) to be mounted on the printing cylinder (14), and a printing cylinder support unit (36) for supporting and moving the printing cylinder (14). The printing cylinder support unit (Continued)

Figure 1:
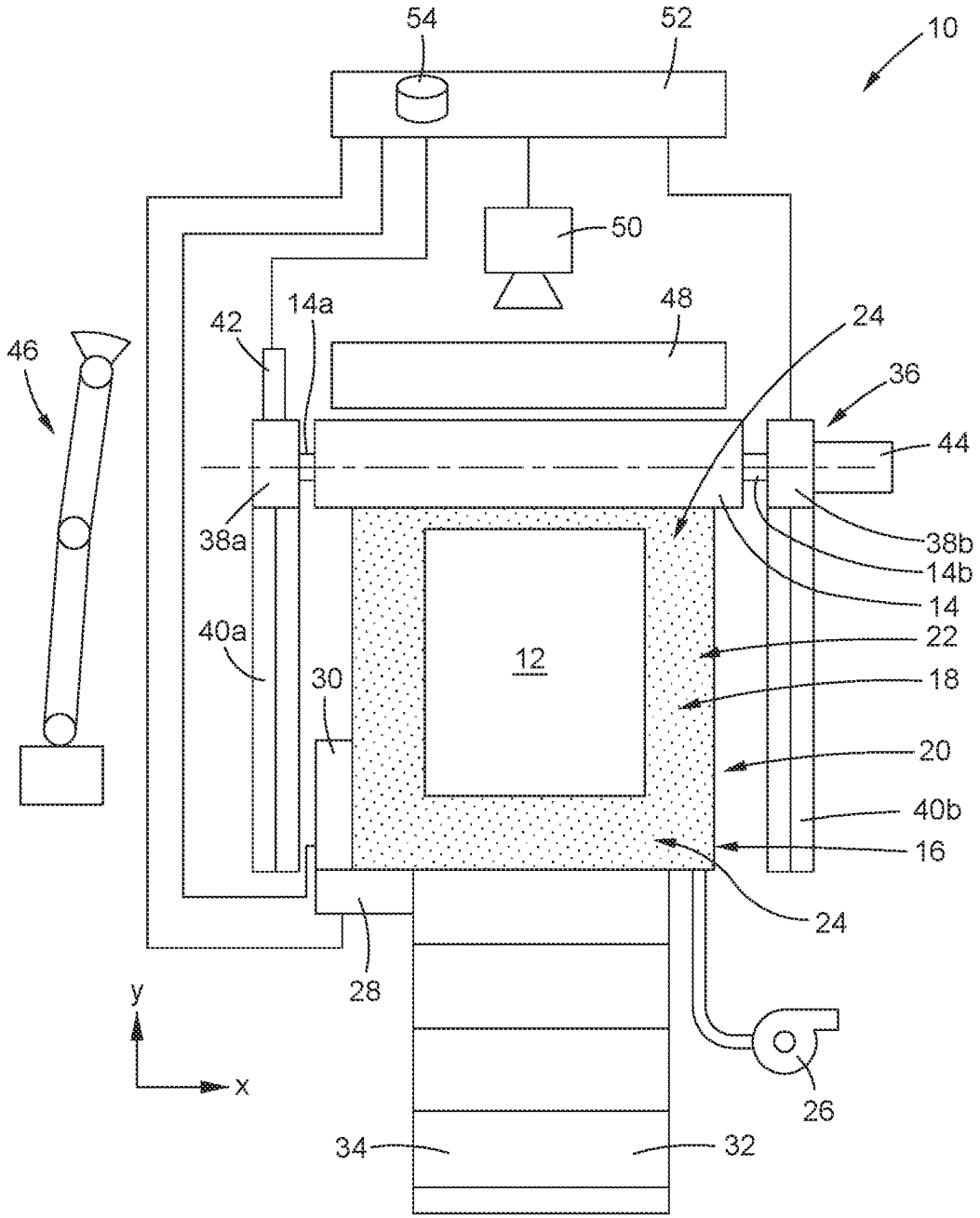

(36) comprises a translatory drive means (42) for translatorily moving the printing cylinder (14) in a direction parallel to the support surface (18).

20 Claims, 3 Drawing Sheets

(56) References Cited

U.S. PATENT DOCUMENTS

| | | | | |
|---|---|---|---|---|
| 6,117,615 | A * | 9/2000 | Riechert | G03F 7/24 430/273.1 |
| 6,684,786 | B2 | 2/2004 | Nagata et al. | |
| 9,852,542 | B1 * | 12/2017 | Ogale | G06F 3/14 |
| 2004/0129157 | A1 * | 7/2004 | Dewitte | B41F 27/005 101/382.1 |
| 2006/0117973 | A1 * | 6/2006 | Zanoli | B41F 27/005 101/481 |
| 2007/0119324 | A1 * | 5/2007 | Yoo | B41F 23/04 101/492 |
| 2009/0013886 | A1 * | 1/2009 | Caliari | B41F 27/005 101/211 |
| 2012/0032946 | A1 * | 2/2012 | Wang | G06T 7/85 345/419 |
| 2014/0104398 | A1 * | 4/2014 | Zoken | G03B 17/561 348/50 |
| 2014/0230674 | A1 * | 8/2014 | Sanger | B41N 6/00 101/477 |
| 2014/0230675 | A1 * | 8/2014 | Sanger | B41F 27/005 101/481 |
| 2014/0230676 | A1 * | 8/2014 | Sanger | B41F 27/005 101/486 |
| 2014/0326152 | A1 * | 11/2014 | Gartner | B41F 27/1268 101/477 |
| 2015/0276369 | A1 * | 10/2015 | Kneezel | G03F 7/20 324/693 |
| 2019/0337289 | A1 | 11/2019 | Leader, Jr. et al. | |
| 2020/0184617 | A1 * | 6/2020 | Perron | G06T 7/38 |

FOREIGN PATENT DOCUMENTS

| | | | |
|---|---|---|---|
| CN | 107428153 | A | 12/2017 |
| EP | 0313510 | A2 | 4/1989 |
| NL | 2015516 | B1 | 4/2017 |

* cited by examiner

METHOD AND APPARATUS FOR ATTACHING A PRINTING PLATE TO A PRINTING CYLINDER

CROSS-REFERENCE TO RELATED APPLICATION(S)

This patent application claims the benefit of priority under 35 U.S.C. § 119 from European Application No. 20208583.3, filed on Nov. 19, 2020, the entirety of which is incorporated herein by reference.

The invention relates to a method for attaching a printing plate, especially a flexographic printing plate, to a printing cylinder.

The invention is additionally directed to an apparatus for attaching a printing plate to a printing cylinder, comprising a printing plate support unit having a substantially flat support surface for supporting the printing plate to be mounted on the printing cylinder. Moreover, the apparatus comprises a printing cylinder support unit for supporting and moving the printing cylinder, having a rotational drive means for rotating the printing cylinder.

In printing machines in general and in flexographic printing machines in particular, an image to be printed on a substrate is often provided on a surface of a printing plate. During a corresponding printing process, ink is applied to the printing plate and the printing result is produced by bringing the printing plate having ink on it in contact with the substrate. It is obvious that in such processes one printing plate is able to produce one printing result only. Consequently, within a given printing machine, especially a flexographic printing machine, printing plates have to be exchanged from time to time, especially between different printing jobs.

In this context, it is usual to use a predefined number of printing cylinders and to remove printing plates currently not needed from the printing cylinder. Currently needed printing plates are subsequently attached to the printing cylinder before it is inserted into a corresponding printing machine.

The printing plates have to be attached to the printing cylinder with high precision in order to ensure high quality of the corresponding printing result.

It is therefore an object of the invention to provide a method and an apparatus for attaching a printing plate to a printing cylinder with increased precision. At the same time the attachment of the printing plate shall be easy and quick.

The problem is solved by a method for attaching a printing plate, especially a flexographic printing plate, to a printing cylinder, comprising the following steps:

a) providing the printing plate in a substantially flat condition,
b) arranging an outer circumference of the printing cylinder adjacent to an edge of the printing plate, and subsequently
c) translatorily moving the printing cylinder over the printing plate while rotating the printing cylinder such that the printing plate is rolled-up on the printing cylinder.

Thus, during the course of the method, the portions of the printing plate which have not yet been attached to the printing cylinder, i.e. which have not yet been rolled-up, substantially stay in a stationary and flat condition. In other words, these portions do not move, especially not within a plane defined by the flat condition of the printing plate. The absence of such movements of the printing plate reduces or eliminates undesired distortions or deformations of the printing plate. As a consequence thereof, the printing plate may be attached to the printing cylinder with very high precision.

In the present context a printing cylinder is to be understood as a generic term covering printing cylinders with and without sleeves. Thus, from a technical point of view, the printing plate may be directly attached to the cylinder or to a sleeve of the cylinder.

The method may be performed in a fully automated manner.

Preferably, an adhesive may be applied to the outer circumference of the printing cylinder or to the printing plate before the printing cylinder is arranged adjacent to the edge of the printing plate. The printing plate is then attached to the printing cylinder by the adhesive. The adhesive may have the form of one or more straps of an adhesive tape.

Compared to prior art methods which usually pull the printing plate on the printing cylinder, the general idea of the present invention consists in rolling the printing cylinder over the printing plate such that the portion of the printing plate currently being located adjacent to the circumference of the printing cylinder sticks thereto. After having rolled over the entire length of the printing plate the entire printing plate is attached to the printing cylinder.

After the printing plate has been attached to the printing cylinder by a method according to the invention, the printing cylinder may be inserted into a corresponding printing machine in a fully automated manner. Correspondingly, a printing cylinder to which a printing plate shall be attached, may be provided in a fully automated manner.

According to an embodiment, the printing plate is provided on a substantially flat support surface of a printing plate support unit. In particular, the printing plate is provided on a top surface of a vacuum table. Consequently, the printing plate is provided in a substantially flat condition with high reliability. When using a printing plate support unit which is not a vacuum table, the printing plate is substantially held in the flat condition by gravity. If the printing plate support unit comprises a vacuum table, the printing plate is additionally fixed on the top surface thereof by vacuum forces.

In a variant wherein the printing plate support unit comprises a vacuum table, the vacuum table is preferably configured such that different portions of the printing plate can be selectively held by vacuum forces. This means that portions of the printing plate which are about to be rolled-up on the printing cylinder may not be held by vacuum forces, whereas portions of the printing plate which are not yet being rolled-up on the printing cylinder are reliably held by vacuum forces. This variant allows for further increased precision in attaching the printing plate to the printing cylinder.

The printing plate may be moved to a predefined position before the printing cylinder is provided adjacent to the edge of the printing plate. The predefined position is arranged such that a printing plate arranged therein may easily and reliably interact with the printing cylinder. Furthermore, the predefined position may be adapted to a position and/or a range of motion of the printing cylinder. In doing so, high precision of attachment is achieved. The predefined position may be a predefined position on the support surface. This means that the printing plate is aligned with the support surface. This alignment may be designated a pre-positioning. It can be performed manually. Alternatively or additionally, the predefined position may be a predefined position with respect to the printing cylinder or a reference position thereof. Thus, the printing plate and the support surface may together be aligned to the printing cylinder or a reference position thereof. To this end the support surface and together with it the printing plate support unit may be movable. This alignment may also be called fine-positioning of the printing plate. Consequently, the precision of attachment is further increased.

In this context, the printing plate may be aligned with a reference mark. In particular, the reference mark is projected on the support surface and/or on the printing plate. The reference mark may be configured such that it is easily detectable, e.g. by the human eye. Consequently, the printing plate may be aligned quickly and reliably. According to a variant the reference mark comprises an image of the printing plate which is projected on the support surface and/or on the printing plate placed thereon. Preferably, a size of the projected image corresponds to the size of the printing plate. Thus, when aligning the printing plate it has to be brought into registration or overlap with the projected image.

According to a variant, one or more 3-dimensional images of the printing plate and/or the printing cylinder are/is captured. In the present context, the 3-dimensional images may be moving images or stationary ones. In other words, the 3D camera unit capturing these images may generate a video sequence or one or more pictures. Preferably, 3-dimensional images are captured during the entire course of the method for attaching the printing plate to the printing cylinder. These images may be used in order to document the correct attachment of the printing plate to the printing cylinder. In a broader sense, the images may be used for quality assurance. It is noted that the 3-dimensional images also comprise 3-dimensional information about the relief as integrated into the printing plate. Compared to conventional, 2-dimensional images this allows for more detailed images.

Also an adhesive applied to the printing plate or the printing cylinder may be captured in a 3-dimensional image. Thus, the correct application of the adhesive may be documented and used for quality assurance.

Advantageously, at least one 3-dimensional image is compared to a digital representation of the printing plate and/or the printing cylinder in order to control or check the attachment of the printing plate. One result of this comparison may be that the content of the 3-dimensional image only deviates within a predefined range of tolerance from the digital representation. Then, the attachment of the printing plate to the printing cylinder is approved, i.e. it is considered to be sufficiently precise. In the opposite case, where the deviation lies outside the predefined range of tolerance, the attachment of the printing plate to the printing cylinder is not approved and needs to be corrected. It is also possible to perform this comparison in a closed-control loop such that the relative position of the printing cylinder and the printing plate can be manipulated depending on the outcome of the comparison. In this context, the camera unit capturing the 3-dimensional image may be considered to be a sensor.

The problem is also solved by an apparatus of the type mentioned above for attaching a printing plate to a printing cylinder, wherein the printing cylinder support unit comprises a translatory drive means for translatorily moving the printing cylinder in a direction parallel to the support surface. Consequently, the printing cylinder may be rotated about a printing cylinder axis and additionally moved in parallel to the support surface. When combining these two movements, the apparatus is configured such that the printing cylinder may be rolled over the support surface. If a printing plate is placed on the support surface, the printing cylinder may be rolled over the printing plate in order to attach it to the printing cylinder. As has already been explained in connection with the method according to the invention, the apparatus is configured such that the portions of the printing plate which have not yet been attached to the printing cylinder, i.e. which have not yet been rolled-up, substantially stay in a stationary and flat condition. Consequently, these portions do not move, especially not within a plane defined by the support surface. Thus, undesired distortions or deformations of the printing plate are reduced or eliminated. This leads to an attachment of the printing plate to the printing cylinder respecting very narrow tolerances, i.e. being very precise.

The apparatus may also comprise a further translatory drive means for translatorily moving the printing cylinder in a direction perpendicular to the support surface. Thus, the printing cylinder may also be moved in a direction perpendicular to the surface. The further translatory drive means may be used for adapting the apparatus to printing cylinders of different size. It may also be used to adapt the apparatus to different thicknesses of the printing plate. Additionally, the further translatory drive means may be used for adjusting a pressure resulting from the contact between the printing cylinder and the printing plate.

According to an embodiment, the apparatus comprises an adhesive application unit for applying an adhesive, in particular an adhesive tape, to the printing cylinder or the printing plate. The adhesive is used for reliably attaching the printing plate to the printing cylinder. The adhesive application unit preferably operates in a fully automatic manner.

Alternatively or additionally, the apparatus comprises a printing cylinder handling unit for inserting a printing cylinder into the printing cylinder support unit and withdrawing a printing cylinder from the printing cylinder support unit. In particular, the printing cylinder handling unit comprises an industrial robot. Preferably, the printing cylinder handling unit operates in a fully automatic manner. Thus, printing cylinders may be inserted into the apparatus and withdrawn therefrom in a fully automatic manner.

The apparatus may comprise a feeding unit for automatically arranging a printing plate on the support surface. The feeding unit may comprise a conveyor belt or an industrial robot. In both alternatives, the printing plate may be arranged on the support surface in a reliable and quick manner.

In an alternative, the printing plate support unit comprises a vacuum table wherein the substantially flat support surface is a top surface of the vacuum table. Consequently, the printing plate may be fixed on the top surface by vacuum forces. Thus, reliable and precise positioning can be guaranteed. Moreover, the vacuum table is preferably configured such that the vacuum forces may be selectively applied to different portions of the printing plate. In other words, the vacuum table is configured for liberating portions of the printing plate which are about to be rolled-up on the printing cylinder, whereas portions of the printing plate which are not yet being rolled-up on the printing cylinder are reliably fixed. As a result thereof, the printing plate may be attached to the printing cylinder with high precision.

The printing plate support unit may be movable in two directions being parallel to the support surface. In particular, the two directions comprise a longitudinal and a transversal direction of the support surface. Thus, the printing plate support unit is movable with respect to the printing cylinder support unit. Consequently, a position of a printing plate arranged on the printing plate support unit may be adjusted with respect to a printing cylinder being arranged in the printing cylinder support unit. Consequently, the precision of attachment may be further increased.

Also, the apparatus may comprise a projector unit being configured and arranged for projecting an image of a printing plate on the support surface and/or a printing plate provided thereon. The image may serve as a reference mark for positioning the printing plate on the support surface. Consequently, it is easy to position the printing plate in a predefined position on the support surface.

According to an embodiment, the apparatus comprises a 3D camera unit configured for capturing a 3-dimensional image of the printing plate and/or the printing cylinder. Again, the 3-dimensional images may be moving images or stationary ones. In other words, the 3D camera unit capturing these images may generate a video sequence or one or more pictures. These images may be used in order to document the correct attachment of the printing plate to the printing cylinder. In a broader sense, the images may be used for quality assurance.

Also an adhesive applied to the printing plate or the printing cylinder may be captured by the 3D camera unit. Thus, also the correct application of the adhesive may be documented and used for quality assurance.

Furthermore, the apparatus may comprise a control unit being coupled to the 3D camera unit and being configured for comparing a 3-dimensional image captured by the 3D camera unit to a digital representation of the printing plate and/or the printing cylinder. A result of this comparison may be that the content of the 3-dimensional image only deviates within a predefined range of tolerance from the digital representation. Then the attachment of the printing plate to the printing cylinder is approved, i.e. it is considered to be sufficiently precise. In an alternative case, where the deviation lies outside the predefined range of tolerance, the attachment of the printing plate to the printing cylinder is not approved and needs to be corrected. It is also possible that the control unit operates as a closed loop controller. Then the relative position of the printing cylinder and the printing plate is manipulated depending on the outcome of the comparison. In this context, the camera unit capturing the 3-dimensional image operates as a sensor.

The effects and advantages mentioned in connection with the apparatus according to the invention also apply to the method according to the invention and vice versa.

Figure 2:
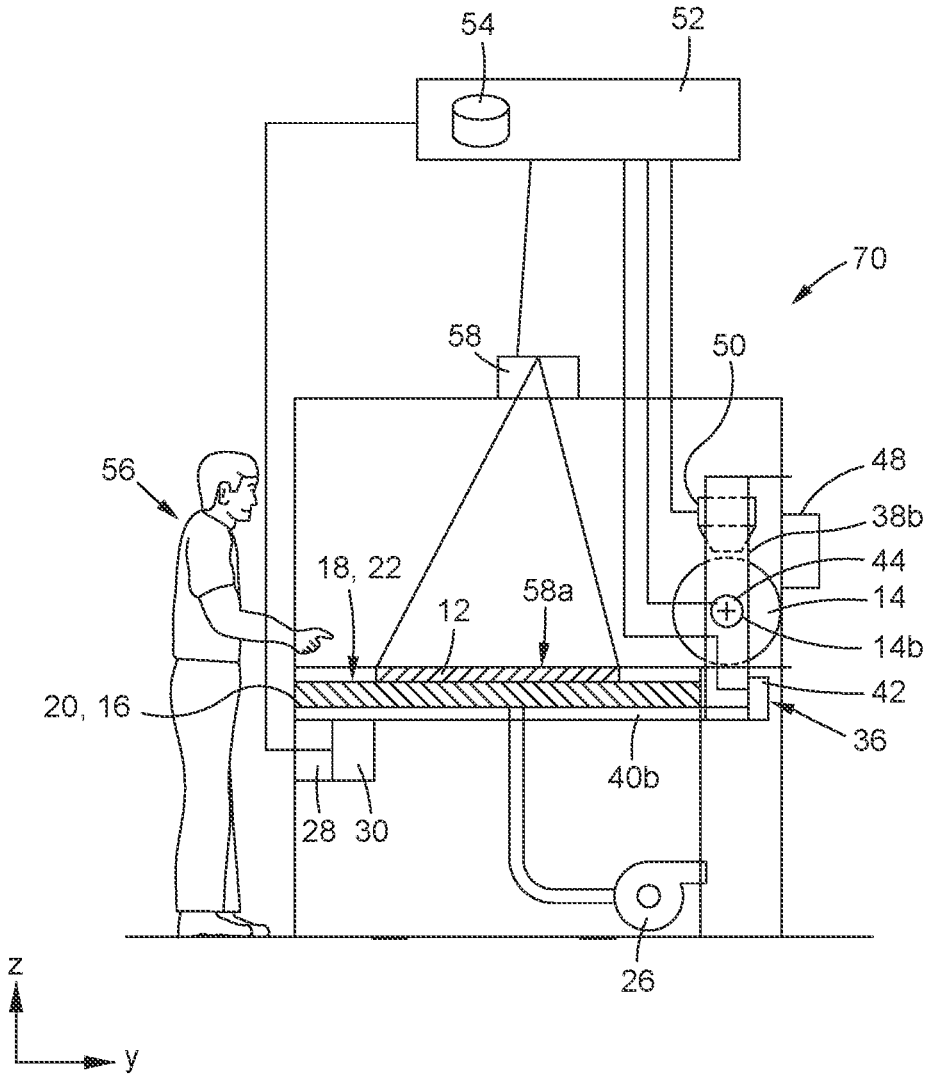
Figure 3A:
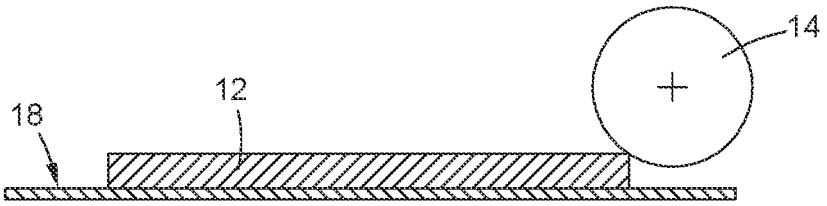
Figure 3B:
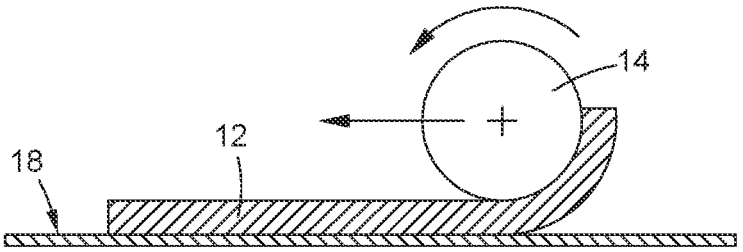
Figure 3C:
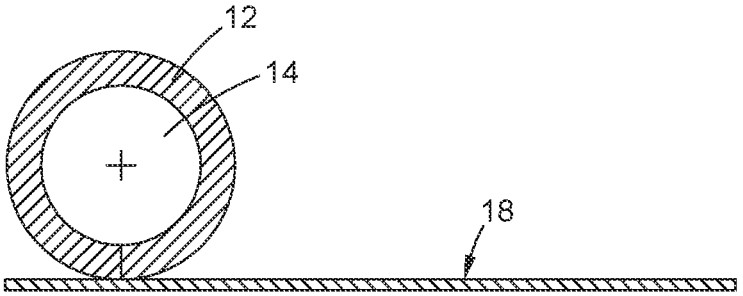

The invention will now be explained with reference to two embodiments which are shown in the attached drawings. In the drawings, FIG. 1 is a schematic top view of an apparatus according to a first embodiment of the invention which can be used for performing a method according to the invention, FIG. 2 is a schematic side view of an apparatus according to a second embodiment of the invention which can also be used for performing a method according to the invention, and FIGS. 3*a*, 3*b*, and 3*c* schematically illustrate the method according to the invention.

FIG. 1 shows an apparatus 10 for attaching a printing plate 12 to a printing cylinder 14.

In the present example the printing plate 12 is a flexographic printing plate and the printing cylinder 14 is a printing cylinder of a flexographic printing machine.

The apparatus 10 comprises a printing plate support unit 16 having a substantially flat support surface 18.

The printing plate support unit 16 comprises a vacuum table 20, wherein the support surface 18 is formed by a top surface 22 of the vacuum table 20.

The top surface 22 is oriented in a substantially horizontal manner and comprises a plurality of suction openings 24 which are configured for aspiring the printing plate 12.

For the ease of representation only two of the suction openings 24 are designated with a reference sign.

The suction openings 24 are fluidically connected to a vacuum pump 26.

Furthermore, a shut-off valve (not shown) is fluidically interposed between each of the suction openings 24 and the vacuum pump 26.

By operating the shut-off valves, each of the suction openings 24 may be selectively connected to the vacuum pump 26, i.e. each of the suction openings 24 may individually and selectively be put in a condition in which it may aspire the printing plate 12 or in a condition where it does not aspire the printing plate 12.

Moreover, the printing plate support unit 16 is coupled to a first support drive 28 and a second support drive 30.

The first support drive 28 is configured for moving the printing plate support unit 16 along an x direction and the second support drive 30 is configured for moving the printing plate support unit 16 along a y direction.

The x direction and the y direction are substantially parallel to the support surface 18. In this respect the x direction may be designated a transversal direction and the y direction a longitudinal direction.

In the present example the printing plate 12 to be mounted on the printing cylinder 14 is arranged in on the support surface 18 i.e. on the top surface 22 of the vacuum table 20.

The apparatus 10 also comprises a feeding unit 32 for automatically arranging the printing plate 12 on the support surface 18.

The feeding unit 32 comprises a conveyor belt 34 which is configured for moving the printing plate 12 substantially along they direction and placing it on the support surface 18.

Furthermore, the apparatus 10 comprises a printing cylinder support unit 36 for supporting and moving the printing cylinder 14.

The printing cylinder support unit 36 has a first support structure 38*a* for supporting a shaft end 14*a* of the printing cylinder 14.

The printing cylinder support unit 36 has also a second support structure 38*b* for supporting a shaft end 14*b* of the printing cylinder 14.

The shaft ends 14*a*, 14*b* are arranged on opposing ends of a shaft of the printing cylinder 14. Consequently, the support structures 38*a*, 38*b* are also arranged on opposing sides of the printing cylinder 14.

Moreover, the support structures 38*a*, 38*b* are arranged on opposing sides of the printing plate support unit 16.

Both support structures 38*a*, 38*b* are coupled to respective guide means 40*a*. 40*b* which are guide rails in the present example.

The guide means 40*a*, 40*b* substantially extend over the entire length of the printing plate support unit 16 in the y direction.

Moreover, the printing cylinder support unit 36 comprises a translatory drive means 42 for translatorily moving the support structures 38*a*, 38*b* and the printing cylinder 14 supported therewith in they direction.

Thus, the printing cylinder 14 may travel over the entire length of the printing plate support unit 16 in the y direction.

The printing cylinder support unit 36 also has a rotational drive means 44. The printing cylinder 14 may be rotationally coupled to the rotational drive means 44 such that it may be rotated.

Furthermore, the apparatus 10 has a printing cylinder handling unit 46 comprising an industrial robot.

The printing cylinder handling unit 46 is configured for inserting the printing cylinder 14 into the printing cylinder support unit 36 and withdrawing the printing cylinder 14 therefrom.

Moreover, the apparatus 10 comprises an adhesive application unit 48 for applying an adhesive to the printing cylinder 14.

In the present example the adhesive application unit 48 is configured for applying straps of an adhesive tape to an outer circumference of the printing cylinder 14. The adhesive is used for sticking the printing plate 12 on the outer circumference of the printing cylinder 14 as will be explained below.

The apparatus 10 also comprises a 3D camera unit 50.

It is configured and arranged for capturing 3-dimensional images of the printing plate 12, the printing cylinder 14 and the adhesive.

In other words, the 3D camera unit 50 is configured for monitoring the entire process being performed by the apparatus 10 and all parts being involved in this process.

The 3D camera unit 50 is connected to a control unit 52.

Also the first support drive 28, the second support drive 30, the translatory drive means 42 and the rotational drive means 44 are connected to the control unit 52.

On the control unit 52 a digital representation 54 of the printing plate 12, the printing cylinder 14 and the adhesive is provided.

In the present case this digital representation 54 comprises the printing plate 12, the printing cylinder 14 and the adhesive in a detached state, a state where the printing plate 12 is fully attached to the printing cylinder 14 via the adhesive and various intermediate states. All states forming part of the digital representation 54 are desired or ideal states.

Based on this the control unit 52 is configured for comparing a 3-dimensional image captured by the 3D camera unit 50 to the digital representation 54.

Depending on the outcome of this comparison, the control unit 52 may actuate one or more of the first support drive 28, the second support drive 30, the translatory drive means 42 and the rotational drive means 44.

Consequently, the attachment of the printing plate 12 to the printing cylinder 14 may be performed under closed-loop control wherein the 3D camera unit 50 acts as a sensor and the first support drive 28, the second support drive 30, the translatory drive means 42 and the rotational drive means 44 are actuators.

FIG. 2 shows an apparatus 10 for attaching a printing plate 12 to a printing cylinder 14 according to a second embodiment.

In the following, only the differences with respect to the first embodiment as shown in FIG. 1 will be explained. Corresponding parts will be designated with corresponding reference signs.

The apparatus 10 according to the second embodiment does not comprise a feeder.

The printing plate 12 is manually arranged on the support surface 18 by an operator 56.

In order to help the operator to correctly position the printing plate 12, a projector unit 58 is provided which is configured and arranged for projecting an image 58*a* of the printing plate 12 on the support surface 18 and/or the printing plate 12 provided thereon. The projector unit 58 may receive the image from the control unit 52. The image may form part of the digital representation 54.

For precisely positioning the printing plate 12, the operator 56 needs to bring the printing plate 12 substantially in registration with the image 58*a*.

Also the printing cylinder 14 needs to be manually arranged in the apparatus 10. In the second embodiment, the apparatus 10 does not comprise a printing cylinder handling unit.

For the remaining features and functions reference is made to the explanations given in respect of the first embodiment.

Both the apparatus 10 according to the first embodiment and the apparatus 10 according to the second embodiment may be used for performing a method for attaching the printing plate 12 to the printing cylinder 14.

As a first step of this method the printing plate 12 is provided in a substantially flat condition on the support surface 18 of the printing plate support unit 16, i.e. on the top surface 22 of the vacuum table 20.

If the apparatus 10 is configured according to the first embodiment, this is done automatically and the printing plate 12 is moved to a predefined position on the support surface 18.

If the apparatus 10 is configured according to the second embodiment, this is done by the operator 56, wherein the image 58*a* of the printing plate 12 is projected on the support surface 18 and/or on the printing plate 12 arranged thereon by the projector unit 58. The projected image 58*a* serves as a reference mark.

The operator 56 aligns the printing plate 12 with the reference mark such that the printing plate 12 is arranged in a predefined position.

At the same time, before or afterwards an adhesive is applied to the printing cylinder 14.

Thereafter, an outer circumference of the printing cylinder 14 is arranged adjacent to an edge of the printing plate 12 (see FIG. 3*a*).

Subsequently, the printing cylinder 14 is rotated by the rotational drive means 44 and moved translatorily by the translatory drive means 42 such that the printing plate 12 is rolled-up on the printing cylinder 14 (see arrows in FIG. 3*b*).

This is done until the printing cylinder 14 reaches the end of the printing plate 12, i.e. the translatory movement of the printing cylinder 14 covers the printing plate 12.

Then, the printing plate 12 is fully attached to the printing cylinder 14 (see also FIG. 3*c*).

During the entire course of the method, 3-dimensional images of the printing plate 12, the printing cylinder 14 and the adhesive are captured by the 3D camera unit 50.

Within predefined time intervals the 3-dimensional images are compared to the digital representation 54.

If the 3-dimensional image differs from the digital representation 54 more than a predefined tolerance, the rolling-up of the printing plate 12, i.e. the attachment of the printing plate 12 to the printing cylinder 14, is corrected by actuating one or more of the first support drive 28, the second support drive 30, the translatory drive means 42 and the rotational drive means 44.

Thus, the printing plate 12 is attached to the printing cylinder 14 under closed-loop control.

As a result of the method, the printing plate 12 is attached to the printing cylinder 14 in a precise manner.

The invention claimed is:

1. A method for attaching a printing plate, especially a flexographic printing plate, to a printing cylinder, the method comprising:

providing the printing plate in a substantially flat condition, arranging an outer circumference of the printing cylinder adjacent to a first edge of the printing plate, and subsequently translatorily moving the printing cylinder over the printing plate while rotating the printing cylinder such that the printing plate is rolled-up on the printing cylinder from the first edge of the printing plate while a second edge of the printing plate, that is opposite the first edge, remains stationary, wherein one or more 3-dimensional images of the printing plate and/or the printing cylinder are/is captured.

2. The method according to claim 1, wherein the printing plate is provided on a substantially flat support surface of a printing plate support unit, in particular on top surface of a vacuum table.

3. The method according to claim 2, wherein the printing plate is moved to a predefined position before the printing cylinder is provided adjacent to the edge of the printing plate.

4. The method according to claim 3, wherein the printing plate is aligned with a reference mark, especially wherein the reference mark is projected on the support surface and/or on the printing plate.

5. The method according to claim 1, wherein at least one 3-dimensional image is compared to a digital representation of the printing plate and/or the printing cylinder in order to control or check the attachment of the printing plate.

6. An apparatus for attaching a printing plate to a printing cylinder, the apparatus comprising:

a printing plate support unit having a substantially flat support surface for supporting the printing plate to be mounted on the printing cylinder, and a printing cylinder support unit for supporting and moving the printing cylinder over an entire length of the printing plate, and having a rotational drive means for rotating the printing cylinder, wherein the printing cylinder support unit comprises a translatory drive means for translatorily moving the printing cylinder in a direction parallel to the support surface and a 3D camera unit configured for capturing a 3-dimensional image of the printing plate and/or the printing cylinder, and a length of the printing plate is greater than half a length of the support surface.

7. The apparatus according to claim 6, further comprising:

an adhesive application unit for applying an adhesive, in particular an adhesive tape, to the printing cylinder or the printing plate.

8. The apparatus according to claim 6, further comprising:

a printing cylinder handling unit for inserting a printing cylinder into the printing cylinder support unit and withdrawing a printing cylinder from the printing cylinder support unit, in particular wherein the printing cylinder handling unit comprises an industrial robot.

9. The apparatus according to claim 6, further comprising:

a feeding unit for automatically arranging a printing plate on the support surface.

10. The apparatus according to claim 6, wherein the printing plate support unit comprises a vacuum table, and wherein the substantially flat support surface is a top surface of the vacuum table.

11. The apparatus according to claim 6, wherein the printing plate support unit is movable in two directions being parallel to the support surface, in particular a longitudinal and a transversal direction of the support surface.

12. The apparatus according to claim 6, further comprising:

a projector unit being configured and arranged for projecting an image of a printing plate on the support surface and/or a printing plate provided thereon.

13. The apparatus according to claim 6, further comprising:

a control unit being coupled to the 3D camera unit and being configured for comparing a 3-dimensional image captured by the 3D camera unit to a digital representation of the printing plate and/or the printing cylinder.

14. An apparatus for attaching a printing plate to a printing cylinder, the apparatus comprising:

a printing plate support unit having a substantially flat support surface for supporting the printing plate to be mounted on the printing cylinder, and a printing cylinder support unit for supporting and moving the printing cylinder over an entire length of the printing plate, and having a rotational drive means for rotating the printing cylinder, wherein the printing cylinder support unit comprises a translatory drive means for translating the printing cylinder along a line in a plane that is parallel to the support surface such that an outer circumference of the printing cylinder contacts a top surface of the printing plate at a first edge of the printing plate, and the printing plate attaches to the outer circumference of the printing cylinder, and a length of the printing plate is greater than half of a length of the support surface.

15. The apparatus of claim 14, wherein the printing plate further comprises a second edge, and the apparatus is configured to hold the second edge of the printing plate stationary as the printing cylinder translates over the printing plate.

16. The apparatus of claim 15, wherein the support surface is a vacuum table, and the second edge is configured to be held stationary with a vacuum force through a plurality of suction openings of the vacuum table.

17. The apparatus of claim 16, wherein each of the plurality of suction openings is selectively connected to a vacuum pump for creating the vacuum force.

18. The apparatus of claim 14, further comprising a projector unit configured to project an image of the printing plate on the support surface.

19. The apparatus of claim 18, wherein a length of the image is substantially longer than half of the length of the support surface.

20. The apparatus of claim 14, wherein the printing plate support unit is movable in two directions that are parallel to the support surface, wherein the two directions are a longitudinal direction and a transversal direction of the support surface.

* * * * *